United States Patent [19]

Popp et al.

[11] 4,020,377

[45] Apr. 26, 1977

[54] HIGH PRESSURE MERCURY VAPOR DISCHARGE LAMP

[75] Inventors: Hanns-Peter Popp, Hattingen; Walter Pilz, Wolfratshausen, both of Germany

[73] Assignee: Patent-Treuhand-Gesellschaft fur Elektrische Gluhlampen mbH, Munich, Germany

[22] Filed: Apr. 8, 1976

[21] Appl. No.: 674,856

[30] Foreign Application Priority Data

Apr. 30, 1975 Germany ..... 2519377

[52] U.S. Cl. ..... 313/112; 313/184; 313/218; 313/220; 313/225; 313/229

[51] Int. Cl.[2] ..... H01J 61/068; H01J 61/18; H01J 61/33; H01J 61/40

[58] Field of Search ..... 313/229, 184, 220, 218, 313/225, 112

[56] References Cited

UNITED STATES PATENTS

| | | | |
|---|---|---|---|
| 3,530,327 | 9/1970 | Zollweg et al. | 313/184 |
| 3,654,506 | 4/1972 | Kuhl et al. | 313/184 |
| 3,753,018 | 8/1973 | Beijer et al. | 313/229 X |
| 3,842,307 | 10/1974 | Dobrusskin et al. | 313/229 X |

*Primary Examiner*—Palmer C. Demeo
*Attorney, Agent, or Firm*—Flynn & Frishauf

[57] ABSTRACT

An improved high pressure mercury vapor discharge lamp having a high color temperature together with high luminous efficacy and a high color rendering. This is accomplished by including in the filling halides of at least one of the rare-earth metals dysprosium, holmium, thulium, erbium, and terbium; together with the halides of at least one of the alkali or alkaline earth metals; and including a filtering agent for radiation in the blue spectral region. The lamp is preferably of isothermal design. The electrodes preferably contain 1–3% of $Dy_2O_3$.

14 Claims, 2 Drawing Figures

HIGH PRESSURE MERCURY VAPOR DISCHARGE LAMP

BACKGROUND OF THE INVENTION

The invention relates to a high pressure mercury vapor discharge lamp. The lamp comprises a discharge vessel of light-transmissive material having high strength at high temperatures, and electrodes of refractory material sealed into the discharge vessel. It is filled with mercury as a buffer gas, an inert gas as the ignition gas, and at least one emitting metal halide and at least one further metal halide.

High pressure mercury vapor discharge lamps which contain metal halide additives are known. DT-PS 1 184 008, for instance, discloses the halides of metals of Group I - III of the Periodic Table as such additives. U.S. Pat. No. 3,654,506 discloses the halides of the rare-earth metals as such additives. U.S. Pat. No. 3,753,018 discloses as additives, the iodides of sodium, lithium, cadmium, thallium, indium, tin, dysprosium and scandium, and preferably the combination of sodium, thallium and indium. Canadian patent No. 936,907 discloses as the emitting substance, the iodides of thallium, scandium, calcium, cesium, dysprosium, sodium, samarium or tin, lanthanum, lithium and barium, and as a non-emitting buffer substance the iodides of antimony, arsenic, bismuth, indium, zinc, cadmium and lead. The purpose of these additives to the mercury, which are excited to luminosity, is to bring about in the aforesaid lamps as white a light emission as possible and a high luminous efficacy. Lamps with additives which predominantly emit radiation of the resonant lines may have high or low color temperatures, but color rendering is unsatisfactory in most cases ($R_a$ is low). Lamps containing rare-earth metal additives, on the other hand, display a multiline spectrum. They have a high color temperature of about 6000 K together with the high luminous efficacy of more than 70 lm/W, and a good color rendering ($R_a$ is high). Moreover, it is well known that lamps containing tin halide additives to the mercury, which are excited only to luminosity, display continuous molecular radiation with a predominantly low color temperature of about 4000–5000 K and good color rendering of $R_a$ greater than 85, but that the luminous efficacy of about 50 lm/W is extremely low and insufficient for a large variety of uses (U.S. Pat. No. 3,566,178).

It is an object of the present invention to provide a lamp which in contradistinction to the aforesaid has the advantageous combination of a low color temperature, and at the same time a high luminous efficacy and good color rendering, namely, a high color rendering index $R_a$.

SUBJECT MATTER OF THE PRESENT INVENTION

The high pressure mercury vapor discharge lamp comprises a discharge vessel of light-transmissive material having high strength at high temperature, with electrodes of refractory material sealed into the discharge vessel. It is filled with mercury as the buffer gas and an inert gas as the starting gas, and at least one emitting metal halide and at least one further metal halide. It is characterized by containing halides of one or more of the rare-earth metals dysprosium, holmium, thulium, erbium, terbium for preferred excitation of molecular emission in the orange-red spectral region, and halides of one or more of the alkali or alkaline-earth metals in combination with thallium halide to increase the vapor pressure of the rare-earth metal halides, and an agent which acts as a filter in the blue spectral region, to obtain a lamp having a low color temperature of below 4,500 K, but at the same time a high luminous efficacy of >70 lm/W and good color rendering with $R_a$ greater than 70. The filtering agent may comprise the tin iodide added to the filling or, a coating applied to the discharge vessel or to the outer envelope. Moreover, the material of the discharge vessel or of the outer envelope itself may act as a filter due to a respective additive included in said material.

Because of the small size of the lamp assembly, the arc is electrode-stabilized so as to inhibit instability of arc. When the electrodes are of refractory material, preferably tungsten, they are suitably activated with 1–3% by weight of dysprosium oxide ($Dy_2O_3$). The electrodes should not be activated with thorium oxide because the thorium oxide of the emitter (electrode) will react with the halide of the rare-earth metals in the filling. The rare-earth metal halides in the filling are converted into oxides and the thorium oxide into a halide.

For satisfactory lamp performance it is moreover of importance to provide an optimum configuration of the discharge vessel, i.e., to provide an isothermal design. For this, the isothermal lines of cylindrical plasma discharges were theoretically determined by designing cylindrical arcs with surface radiators, i.e. with electrodes. The result is an ellipsoidal arc-tube shape with a smaller size ellipsoid superimposed at the arc tube end portions such as to form a sort of bell shape at the ends. This isothermal arc tube design exhibits cold spots in which the partial pressure of the metal halides is reduced.

BRIEF DESCRIPTION OF THE DRAWINGS

The lamp according to the invention is illustrated by way of example in the accompanying drawings, wherein

In FIG. 1, the discharge vessel 1 of quartz glass is of isothermal design and has an internal diameter of 10 mm and a volume of about 1 cc. An electrode 2 or 3 of tungsten activated with dysprosium oxide is located at each end of the discharge vessel. The electrodes 2 and 3 are connected to the wire leads 6 and 7 by means of foil seals 4 and 5. The electrode spacing is 10 mm. The end portions of the discharge vessel 1 are provided with a coating 8 or 9, respectively, of zirconium dioxide which reflects thermal radiation. Discharge vessel 1 is mounted on supports 10 and 11, in an outer envelope 13 which is provided at one end with a screw base 12. The filling of the discharge vessel comprises an ignition gas, e.g. argon of 30 torr and, per cubic centimeter of bulb volume, 10 mg Hg, 0.6 mg Dy, 0.4 mg NaI, 0.2 mg TlI, 0.7 mg Sn, 1 mg $HgI_2$, and 0.9 mg $Br_2$. The structural data and the fill quantities apply to a lamp having a power input of 250 W which is operated with about 3 A and has an operating voltage of about 100 V. The luminous flux is about 20,000 lumens, the luminous efficacy 80 lm/W. The color temperature is 3,300 K. The color rendering index $R_a$ is 90.

An illustrative lamp filling comprises an ignition gas and, per cubic centimeter of volume, 10 mg Hg, 0.6 mg Dy, 0.4 mg NaI, 0.2 mg TlI, 0.7 mg Sn, 1 mg $HgI_2$, and 0.9 mg $Br_2$ which replaces some of the stoichiometrically required iodine. Due to the molecular radiation of the dysprosium iodide, an intense red emission is obtained. The small amount of sodium iodide and thallium iodide which is added causes a high vapor pressure of the dysposium by formation of complex molecules. The emission of molecular continuum radiation and of multiline spectra yields a good color rendering index, the additives of sodium- and thallium iodide increasing the vapor pressure to provide the high luminous efficacy, and the addition of tin iodide brings about absorption of blue radiation and, consequently, the low color temperature. The mercury also causes a high pressure and a large collision cross-section. It is not excited. The addition of bromine when compared with iodine brings about earlier initiation of the halogen regenerative cycle.

Figure 1:
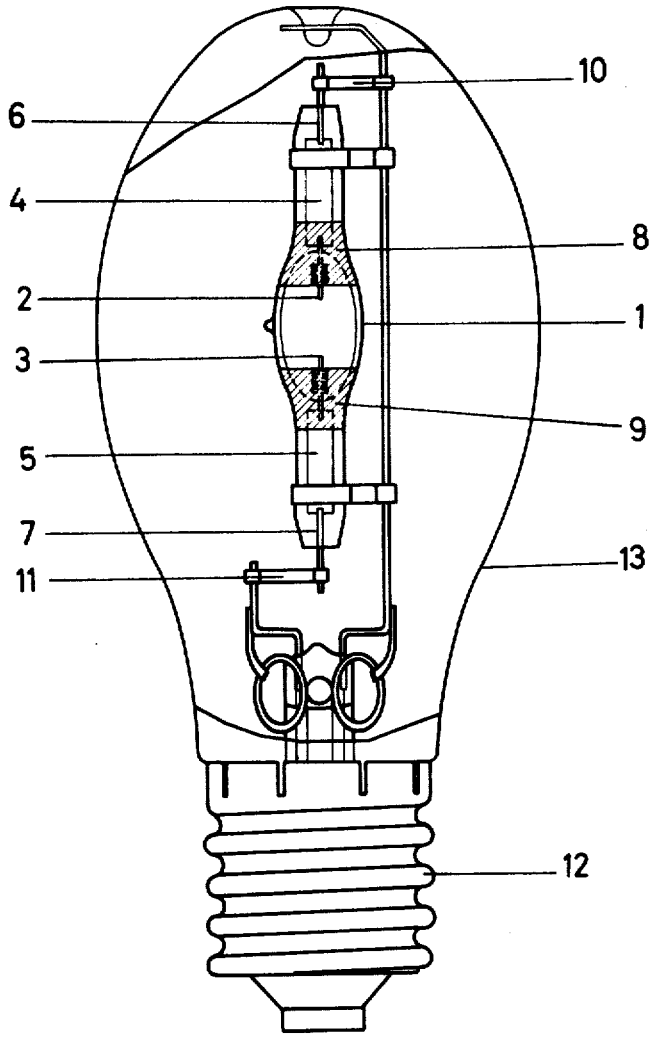
FIG. 1 is a longitudinal section through the lamp with outer envelope.
Figure 2:
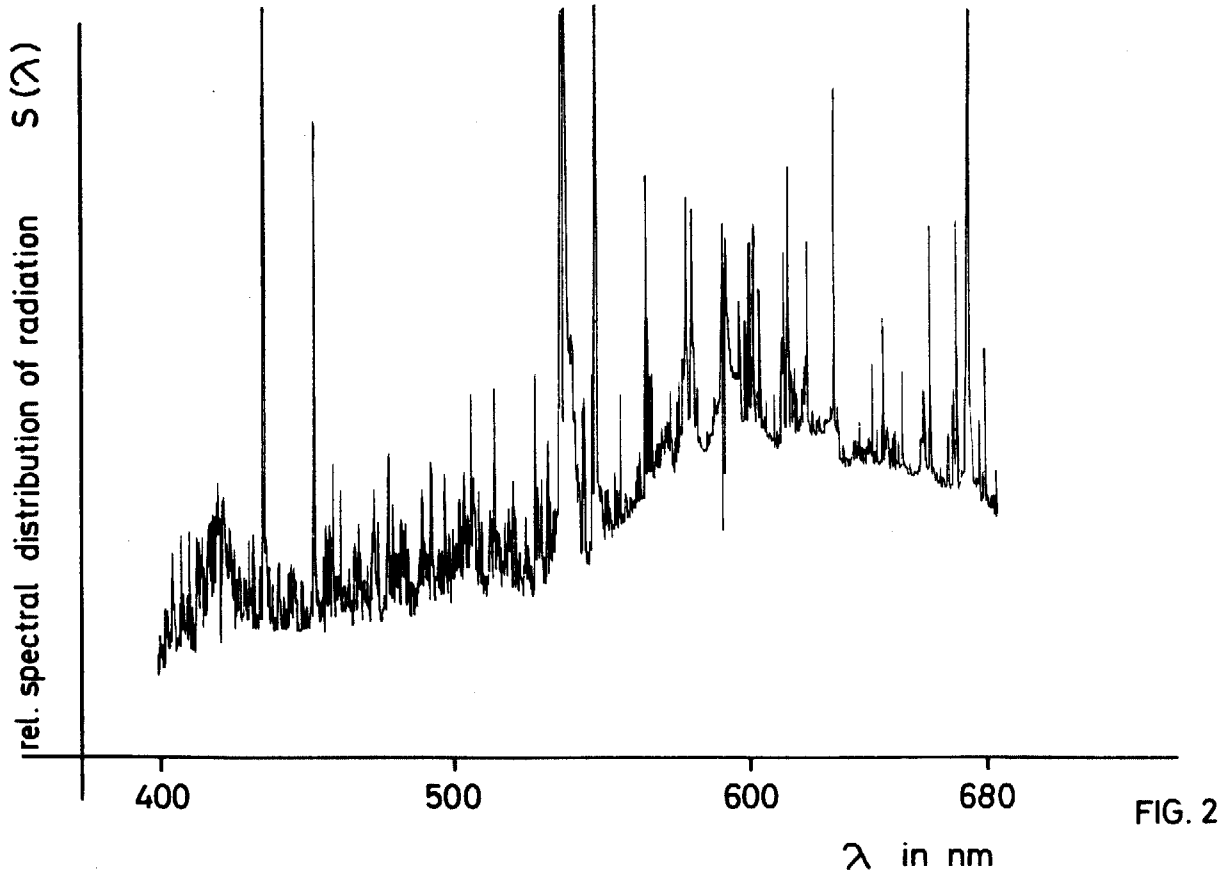
FIG. 2 shows the relative spectral distribution of radiation of the lamp.

The relative spectral distribution of radiation of FIG. 2 discloses the intense molecular continuum of the dysprosium halide in the red region of the spectrum. The green-blue region of the spectrum is dominated by the multiline radiation of the dysprosium atom; it is reduced in the blue region by the addition of the tin iodide. The addition of sodium hardly changes the spectrum at all and is only weakly to be observed as a self-absorption line.

The characteristics of the different types of lamps are compared with the lamp of the present invention in the following table:

| 250 - 400 W | Luminous Efficacy | Color Temperature | $R_a$ |
|---|---|---|---|
| Halogen cycle incand. lamp | 30–35 lm/W | 3200 K | 99 |
| Line radiator | 80 lm/W | 4000–6000 K | 50–60 |
| Multiline radiator | 80 lm/W | 5000–6000 K | 85 |
| Continuum radiator (molecules) | 50–55 lm/W | 4000–6000 K | 90 |
| Lamp of the present invention | 80 lm/W | 3000–4000 K | 90 |

The advantages of the lamp of this invention are evident, namely, the combination of a high luminous efficacy of 80 lm/W, a good color rendering $R_a$ 90, and a low color temperature of 3200 K.

The lamps in accordance with the invention are preferentially suited for the illumination of large interiors, but are also suitable for street lighting.

Xenon and/or argon are suitable inert ignition gases.

What is claimed is:

1. A high pressure mercury vapor discharge lamp comprising a light-transmissive discharge vessel;

spaced electrodes sealed into the discharge vessel;

a filling in said discharge vessel comprising mercury as the buffer gas, an inert ignition gas, at least one halide of at least one of the rare-earth metals selected from the group consisting of dysprosium, holmium, thulium, erbium, and terbium to effect excitation of molecular emission in the orange-red spectral region, and thallium halide together with at least one halide of at least one metal selected from the group consisting of alkali and alkaline-earth metals to increase the vapor pressure of said rare-earth metal halides; and a filtering agent acting as a filter in the blue spectral region, whereby when said lamp is discharged by passing a current through said electrodes, the lamp has a color temperature less than 4,500 K, a luminous efficacy of more than 70 lm/W, and a color rendering $R_a$ greater than 70.

2. The lamp of claim 1 wherein said filtering agent is tin iodide which is included in the filling in the discharge vessel.

3. The lamp of claim 2 wherein said electrodes are refractory metal electrodes, and wherein said halides are at least one halide selected from the group consisting of iodine and bromine.

4. The lamp of claim 3 wherein said filling in the discharge vessel contains dysprosium, sodium, thallium, tin, iodine, bromine, mercury, and the inert ignition gas.

5. The lamp of claim 4 containing per cubic centimeter of volume of the discharge vessel, 10 mg Hg, 0.6 mg Dy, 0.4 mg NaI, 0.2 mg TlI, 0.7 mg Sn, 1 mg $HgI_2$, and 0.9 mg $Br_2$.

6. The lamp of claim 5 wherein the electrodes are tungsten electrodes containing between 1 and 3% by weight of dysprosium oxide.

7. The lamp of claim 1 wherein the electrodes stabilize the discharge arc which forms between the electrodes when the lamp is in operation.

8. The lamp of claim 7 wherein said electrodes comprise a refractory metal containing between 1 and 3% by weight of dysprosium oxide.

9. The lamp of claim 8 wherein said discharge vessel has isothermal characteristics with bell-shaped electrode spaces.

10. The lamp of claim 1 wherein said discharge vessel has isothermal characteristics with bell-shaped electrode spaces.

11. The lamp of claim 4 wherein said discharge vessel has isothermal characteristics with bell-shaped electrode spaces.

12. The lamp of claim 6 wherein said discharge vessel has isothermal characteristics with bell-shaped electrode spaces.

13. The vessel of claim 1 wherein said filtering agent is a coating applied to the light-transmissive material of the discharge vessel.

14. The lamp of claim 1 wherein said filtering agent is incorporated in the light-transmissive material comprising the discharge vessel.

* * * * *